US007126089B1

(12) United States Patent
Barr

(10) Patent No.: US 7,126,089 B1
(45) Date of Patent: Oct. 24, 2006

(54) HIGH ALTITUDE OVEN

(76) Inventor: Rita K. Barr, 1906 Sunshine Ct., Thousand Oaks, CA (US) 91362-4840

( * ) Notice: Subject to any disclaimer, the term of this patent is extended or adjusted under 35 U.S.C. 154(b) by 0 days.

(21) Appl. No.: 10/395,786

(22) Filed: Mar. 24, 2003

(51) Int. Cl.
*F27D 11/00* (2006.01)

(52) U.S. Cl. ..... 219/440; 219/391

(58) Field of Classification Search ..... 219/440, 219/449.1, 391, 394, 395, 396; 126/19 R, 126/21 R, 21 A
See application file for complete search history.

(56) References Cited

U.S. PATENT DOCUMENTS 3,823,657 A * 7/1974 Luetolf ..... 99/337
4,179,596 A * 12/1979 Bjork ..... 219/686
4,460,332 A * 7/1984 Lawler et al. ..... 432/72
4,851,644 A * 7/1989 Oslin ..... 219/400
4,968,516 A * 11/1990 Thompson ..... 426/233
5,172,627 A * 12/1992 Narcisi et al. ..... 99/330
5,334,402 A * 8/1994 Ovadia ..... 426/241
5,767,487 A * 6/1998 Tippmann ..... 219/440
5,847,574 A * 12/1998 Berry et al. ..... 324/765

* cited by examiner

*Primary Examiner*—Sang Y. Paik
(74) *Attorney, Agent, or Firm*—William E. Hein

(57) ABSTRACT

A high altitude oven that includes a baking compartment that includes a pressure maintenance mechanism for maintaining the baking compartment at sea level atmospheric pressure during operation of the oven.

1 Claim, 1 Drawing Sheet

HIGH ALTITUDE OVEN

TECHNICAL FIELD

The present invention relates to ovens and more particularly to a high altitude oven that includes an oven assembly that includes a sealable baking compartment in connection with a baking compartment pressurization assembly; the baking compartment pressurization assembly including a user setable pressure regulator connected between a compressed nitrogen tank and an inlet end of a high pressure hose; the high pressure hose having an outlet end in connection with the sealable baking compartment; the sealable baking compartment being accessible through an oven door of the oven assembly having a pressure sealing gasket and an oven door locking mechanism for locking the oven door in a closed position to seal the sealable baking compartment; the user setable pressure regulator having elevation level indicating markings adjacent to the adjustment mechanism to allow a user to accurately set the user setable pressure regulator for proper function of the oven.

BACKGROUND ART

Baking food at high elevations can be difficult because the lower atmospheric pressure at higher altitudes causes some foods, particularly baked items such as cakes and the like, to cook differently than they cook at sea level. Because most recipes are formulated for use assuming the cooking conditions to be at sea level, it would be desirable to have an oven having a baking compartment that could be maintained at sea level equivalent conditions during operation.

GENERAL SUMMARY DISCUSSION OF INVENTION

It is thus an object of the invention to provide a high altitude oven that includes an oven assembly that includes a sealable baking compartment in connection with a baking compartment pressurization assembly; the baking compartment pressurization assembly including a user setable pressure regulator connected between a compressed nitrogen tank and an inlet end of a high pressure hose; the high pressure hose having an outlet end in connection with the sealable baking compartment; the sealable baking compartment being accessible through an oven door of the oven assembly having a pressure sealing gasket and an oven door locking mechanism for locking the oven door in a closed position to seal the sealable baking compartment; the user setable pressure regulator having elevation level indicating markings adjacent to the adjustment mechanism to allow a user to accurately set the user setable pressure regulator for proper function of the oven.

Accordingly, a high altitude oven is provided. The high altitude oven includes an oven assembly that includes a sealable baking compartment in connection with a baking compartment pressurization assembly; the baking compartment pressurization assembly including a user setable pressure regulator connected between a compressed nitrogen tank and an inlet end of a high pressure hose; the high pressure hose having an outlet end in connection with the sealable baking compartment; the sealable baking compartment being accessible through an oven door of the oven assembly having a pressure sealing gasket and an oven door locking mechanism for locking the oven door in a closed position to seal the sealable baking compartment; the user setable pressure regulator having elevation level indicating markings adjacent to the adjustment mechanism to allow a user to accurately set the user setable pressure regulator for proper function of the oven.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 2:
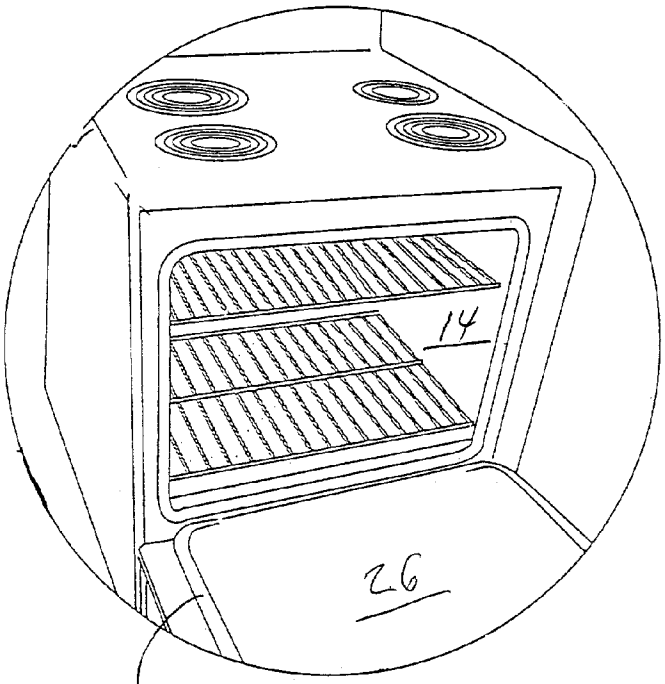
FIG. 2 is a detail perspective view of the sealable oven door of the high altitude oven of FIG. 1 in the open position.
Figure 1:
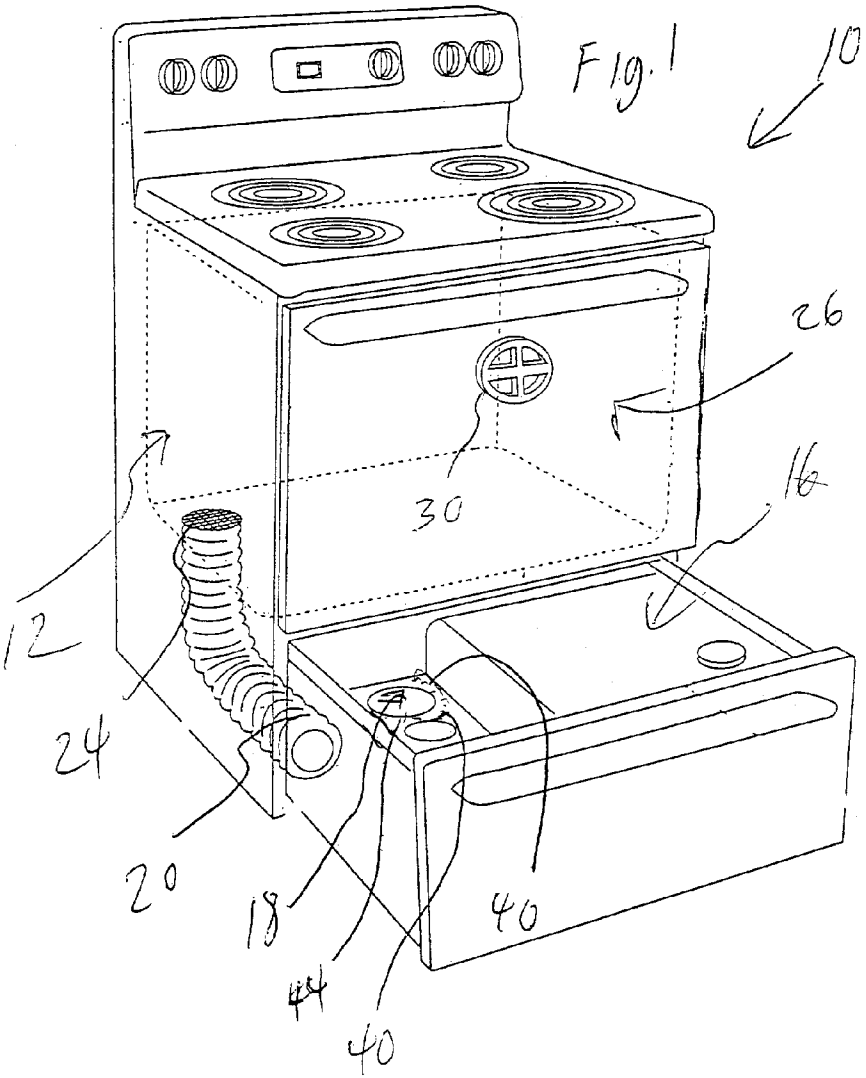
FIG. 1 is a perspective view of an exemplary embodiment of the high altitude oven of the present invention.

FIGS. 1–2 show various aspects of an exemplary embodiment of the high altitude oven of the present invention generally designated 10. High altitude oven 10 includes an oven assembly, generally designated 12, having a sealable baking compartment, generally designated 14, in connection with a baking compartment pressurization assembly, generally designated 16.

Baking compartment pressurization assembly 16 includes a user setable pressure regulator 18 connected between a compressed nitrogen tank 20 and an inlet end 20 of a high pressure hose 22. The high pressure hose 22 having an outlet end 24 in connection with the sealable baking compartment 14. Sealable baking compartment 14 is accessible through an oven door, generally designated 26, of oven assembly 12, that has a pressure sealing gasket 28 and an oven door locking mechanism 30 for locking the oven door 26 in a closed position (shown in FIG. 1) to seal sealable baking compartment 14 during operation of oven 10.

User setable pressure regulator 18 has elevation level markings 40 adjacent to the adjustment knob mechanism 44 thereof to allow a user to accurately set the user setable pressure regulator 18 for proper function of oven 10.

It can be seen from the preceding description that a high altitude oven has been provided.

It is noted that the embodiment of the high altitude oven described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A high altitude oven comprising:

an oven assembly having a sealable baking compartment; and a baking compartment pressurization assembly in communication with said sealable baking compartment, said baking compartment pressurization assembly being operative for establishing and maintaining constant sea level pressure within said sealable baking compartment regardless of an elevation above sea level at which said oven is physically located;

said baking compartment pressurization assembly including a user setable pressure regulator connected between a compressed nitrogen tank and an inlet end of a high pressure hose;

said high pressure hose having an outlet end in connection with said sealable baking compartment;

said sealable baking compartment being accessible through an oven door of said oven assembly, said oven assembly having a pressusre sealing gasket and an oven door locking mechanism for locking the oven door in a closed position to seal said sealable baking compartment;

said user setable pressure regulator comprising adjustment means and associated elevation indication markings for permitting a user to set the elevation above sea level at which said oven is physically located, said pressure regulator being responsive to an elevation setting thereof by the user for admitting nitrogen from said compressed nitrogen tank into said sealable baking compartment for establishing and maintaining constant sea level pressure within said sealable baking compartment.

* * * * *